US005556301A

United States Patent [19]

Chishima et al.

[11] Patent Number: 5,556,301

[45] Date of Patent: Sep. 17, 1996

[54] METHOD AND APPARATUS FOR CONNECTING A PLURALITY OF TERMINALS WITHIN A SINGLE HOUSING

[75] Inventors: Masamitsu Chishima; Yutaka Noro, both of Yokkaichi, Japan

[73] Assignee: Sumitomo Wiring Systems, Ltd., Japan

[21] Appl. No.: 346,225

[22] Filed: Nov. 22, 1994

[30] Foreign Application Priority Data

Nov. 25, 1993 [JP] Japan ..... 5-067941 U
Dec. 22, 1993 [JP] Japan ..... 5-073557 U

[51] Int. Cl.[6] ..... H01R 31/08

[52] U.S. Cl. ..... 439/507; 439/101; 439/511; 439/718; 439/724

[58] Field of Search ..... 439/101, 189, 439/507, 511–513, 595, 599, 686, 701, 718, 724

[56] References Cited

U.S. PATENT DOCUMENTS

| | | | |
|---|---|---|---|
| 4,804,341 | 2/1989 | Kato et al. | 439/752 |
| 5,007,888 | 4/1991 | Goutiere | 439/189 |
| 5,106,318 | 4/1992 | Endo et al. | 439/512 |
| 5,112,239 | 5/1992 | Yagi et al. | 439/189 |
| 5,211,583 | 5/1993 | Endo et al. | 439/595 |
| 5,238,411 | 8/1993 | Jinno et al. | 439/595 |
| 5,326,275 | 7/1994 | Murakami | 439/189 |
| 5,403,204 | 4/1995 | Chishima et al. | 439/189 |

FOREIGN PATENT DOCUMENTS 61-277180 12/1986 Japan .

*Primary Examiner*—P. Austin Bradley
*Assistant Examiner*—Jill DeMello
*Attorney, Agent, or Firm*—Oliff & Berridge

[57] ABSTRACT

A connector housing includes a terminal accommodating chamber communicated through a cutout portion with a space or central chamber in which a joint terminal is accommodated. A terminal is provided with a tongue member resiliently contacting with a short circuit terminal through the cutout portion. When the terminal is inserted into the terminal accommodating chamber, the tongue member contacts and electrically communicates with the short circuit terminal through the cutout portion. The lock piece for holding the terminal is provided on a peripheral wall of the terminal accommodating chamber 11 on a side opposite to the side on which the cutout portion is formed. Therefore, a gap is formed in the periphery of the lock piece. When a current of high intensity flows, the outside of the housing is covered with the cap so as to cover the gap, and the thickness is increased for enhancing the insulating property. If the competent insulating property can be provided only by the thickness of the connector housing, the cap may be removed. In this case, the dimensions of the joint connector can be further reduced.

15 Claims, 5 Drawing Sheets

METHOD AND APPARATUS FOR CONNECTING A PLURALITY OF TERMINALS WITHIN A SINGLE HOUSING

BACKGROUND OF THE INVENTION

The present invention relates to a joint connector, and more particularly, to a joint connector in which electric wires having terminal strips at their ends are accommodated in a housing and predetermined terminals are electrically connected with each other using a short circuit terminal.

Conventionally, this type joint connector is well known, which is disclosed in Japanese Unexamined Patent Publication No. 61-277180. FIG. 8 shows the above joint connector.

In FIG. 8, a plurality of electric wires 3 having female terminals 2 at their ends are accommodated in a female connector housing 1 in such a manner that the plurality of electric wires 3 are oriented in the same direction. A joint connector housing 4 is formed into a box-shape having an opening on one side. A fore end of the female connector housing 1 is capable of being inserted into the opening of the joint connector housing 4. A short circuit terminal 5 is inserted from the outside into a bottom portion of the joint connector housing 4 corresponding to a position at which the female terminal of the female connector housing 1 is disposed. Both end portions of the short circuit terminal 5 are male terminals, which mate with terminals 2. The short circuit terminal 5 is bent at two intermediate positions so that the overall short circuit terminal 5 is formed into a C-shape. A cover 6 is provided on the joint connector housing 4 in such a manner that the bottom portion of the joint connector housing 4 is covered with the cover 6. In order to prevent the cover 6 from being disengaged from the joint connector housing 4, an engaging hole **6*a* is provided on the cover 6, and an engaging protrusion 4*a* is provided on the joint connector housing 4**.

In the construction of the joint connector described above, the integrated short circuit terminal 5 is provided in accordance with the female terminals 2 to be connected with each other. The end portion of the short circuit terminal 5 is inserted from the outside into the joint connector housing 4, and the cover 6 is attached to an outer periphery of the housing 4 so as to cover an exposed portion of the short circuit terminal 5. When the female connector housing 1 is inserted into the opening of the joint connector housing 4, the short circuit terminal 5 advances to the female terminals 2 to be connected, so that the female terminals 2 are communicated with each other through the short circuit terminal 5.

In the conventional joint connector described above, the following problems may be encountered. The joint connector housing 4 is covered with the cover 6, so that the housing is doubled. In addition, when the female connector housing 1 is inserted into the joint connector housing 4, the entire housing is tripled. As a result, the outside dimensions of the joint connector are increased.

SUMMARY OF THE INVENTION

The present invention has been achieved in view of the above problems. It is an object of the present invention to provide a joint connector, the outside dimensions of which are reduced.

In order to accomplish the above object, the present invention provides a joint connector that includes a plate-shaped short circuit terminal and a terminal strip having a flexible connecting piece connected at the end of a connecting wire. The flexible connecting piece protrudes in a direction perpendicular to the axis of the wire. The terminal strip has an engaging recess portion provided on a side opposite to the protruding flexible connecting piece. Also provided is a housing having a joint chamber for accommodating and holding the plate-shaped short circuit terminal. The housing has a plurality of terminal accommodating chambers provided adjacent to the joint chamber in parallel, wherein a communicating hole is provided in the terminal accommodating chamber on the joint chamber side. The connecting piece is capable of protruding into the joint chamber through the communicating hole when the terminal strip is inserted and accommodated. The housing also has a flexible lock arm capable of engaging with the engaging recess portion, the flexible lock arm being provided on a side opposite to the joint chamber wherein the peripheral wall is cut out for the lock arm so that the inside can be communicated with the outside. A detachable cap is provided for covering the outer periphery of the housing so as to cover the cutout portion formed on the outer periphery of the housing.

According to a second aspect of the present invention, there is provided a joint connector including a plate-shaped short circuit terminal; a terminal strip having a flexible connecting piece connected at the end of a connecting wire, the flexible connecting piece protruding in a direction perpendicular to an axis of the wire, the terminal strip also having an engaging recess portion provided on a side opposite to the protruding flexible connecting piece; and a cylindrical housing having a joint chamber for accommodating and holding the plate-shaped short circuit terminal, and also having a plurality of terminal accommodating chambers provided adjacent to the joint chamber in parallel. A communicating hole is provided in the terminal accommodating chamber on the joint chamber side, and the connecting piece is capable of protruding into the joint chamber through the communicating hole when the terminal strip is inserted and accommodated. The housing also has a flexible lock arm capable of engaging the engaging recess portion, the flexible lock arm being provided on a side opposite to the joint chamber wherein the flexible lock arm protrudes from the peripheral wall into the terminal accommodating chamber independently from the peripheral wall.

According to another aspect of the present invention, there is provided a housing having a first set of terminal receiving chambers, a second set of terminal receiving chambers, and a central chamber that communicates the first and second sets of terminal receiving chambers, and a joint terminal insertable within the central chamber to electrically connect terminals located within the first and second sets of terminal receiving chambers.

According to yet another aspect of the present invention, there is provided a method for connecting plurality of terminals located in terminal receiving chambers of a housing. The method includes inserting the terminals within the terminal receiving chambers; communicating each of the terminal receiving chambers with a central chamber of the housing, the central chamber having an electrically conductive joint terminal disposed therein; and establishing an electrical connection between each of the terminals and the joint terminal, thereby connecting each of the terminals to each other.

The operation is conducted, for example, as follows: the joint chamber and the terminal accommodating chamber are provided in the housing integrated into one body. While the plate-shaped short circuit terminal is inserted into the joint chamber, the terminal strip is accommodated in the terminal accommodating chamber provided in parallel with the joint chamber. Then the connecting piece protruding in a direction perpendicular to the axis of the terminal strip is protruded into the joint chamber through the communicating hole of the terminal accommodating chamber, so that the connecting piece contacts and communicates with the short circuit terminal. When a plurality of terminal strips are inserted into the terminal accommodating chambers in the same manner, they are communicated with each other through the short circuit terminal.

On a side of the terminal accommodating chamber opposite to the joint chamber, the lock arm is formed from a cutout portion communicating with the outside of the housing. Therefore, the lock arm is engaged with the engaging recess portion of the terminal strip inserted into the terminal accommodating chamber, so that the terminal strip can not be easily moved.

Because the cutout portion is formed on the outer surface of the housing, the terminal strip is exposed to the outside through a gap of the cutout portion. However, when the housing is covered with a cap, the gap is covered.

Because the short circuit terminal is accommodated in the housing, it is not necessary to provide the cap for covering the exposed portion of the short circuit terminal, so that the construction of the connector housing can be simplified.

The lock arm protruding into the terminal accommodating chamber is provided on a side of the terminal accommodating chamber opposite to the joint chamber. The lock arm is engaged with the engaging recess portion of the terminal strip inserted into the terminal accommodating chamber, so that the terminal strip can not be easily moved.

Alternatively, the housing is formed to be cylindrical, and the lock arm is protruded independently from the peripheral wall of the housing. Accordingly, there are provided no gaps for communicating with the outside in the outer periphery of the housing.

As explained above, according to the present invention, the terminal accommodating chamber is provided in parallel with the joint chamber in which a plate is accommodated, and the short circuit terminal and the terminal strip are accommodated in the housing integrated into one body. Therefore, it is possible to provide a joint connector, the outside dimensions of which are reduced. In this case, the terminal accommodating chamber is provided with a communicating hole on the joint chamber side, and the lock arm is provided on the opposite side. Accordingly, only the bulkhead may be provided on the side, and a plurality of terminal accommodating chambers can be provided in parallel, so that the dimensions of the joint connector can be reduced. However, because the lock arm is provided, a gap communicating with the outside is formed. Accordingly, there is a possibility that the insulating property is deteriorated when a large amount of electric power is transmitted through the connector. Accordingly, if necessary, a detachable cap is applied so as to stop or cover the gap. In this way, the deterioration of the insulating property can be prevented. Further, it is not necessary to attach a cover for covering the housing. Accordingly, the dimensions of the connector can be reduced.

The connector housing is formed cylindrical, and the lock arm is protruded from the connector housing independently from the peripheral wall, and there are provided no gaps for communicating the terminal accommodating chamber with the outside in the outer periphery of the connector housing. Accordingly, even if a cap for covering the connector housing is not provided, the insulation property of the joint connector can be maintained even when a large amount of electric power is transmitted through the joint connector. Therefore, the joint connector of the present invention can be applied not only to a portion through which signals are transmitted but also to a portion through which a current of high intensity is made to flow.

These and other aspects and advantages of the present invention are described in or apparent from the following detailed description of the preferred embodiments.

BRIEF DESCRIPTION OF THE DRAWINGS

The preferred embodiments are described with reference to the drawings, in which.

DETAILED DESCRIPTION OF PREFERRED EMBODIMENTS

With reference to the accompanying drawings, an example of the present invention will be explained as follows.

Figure 1:
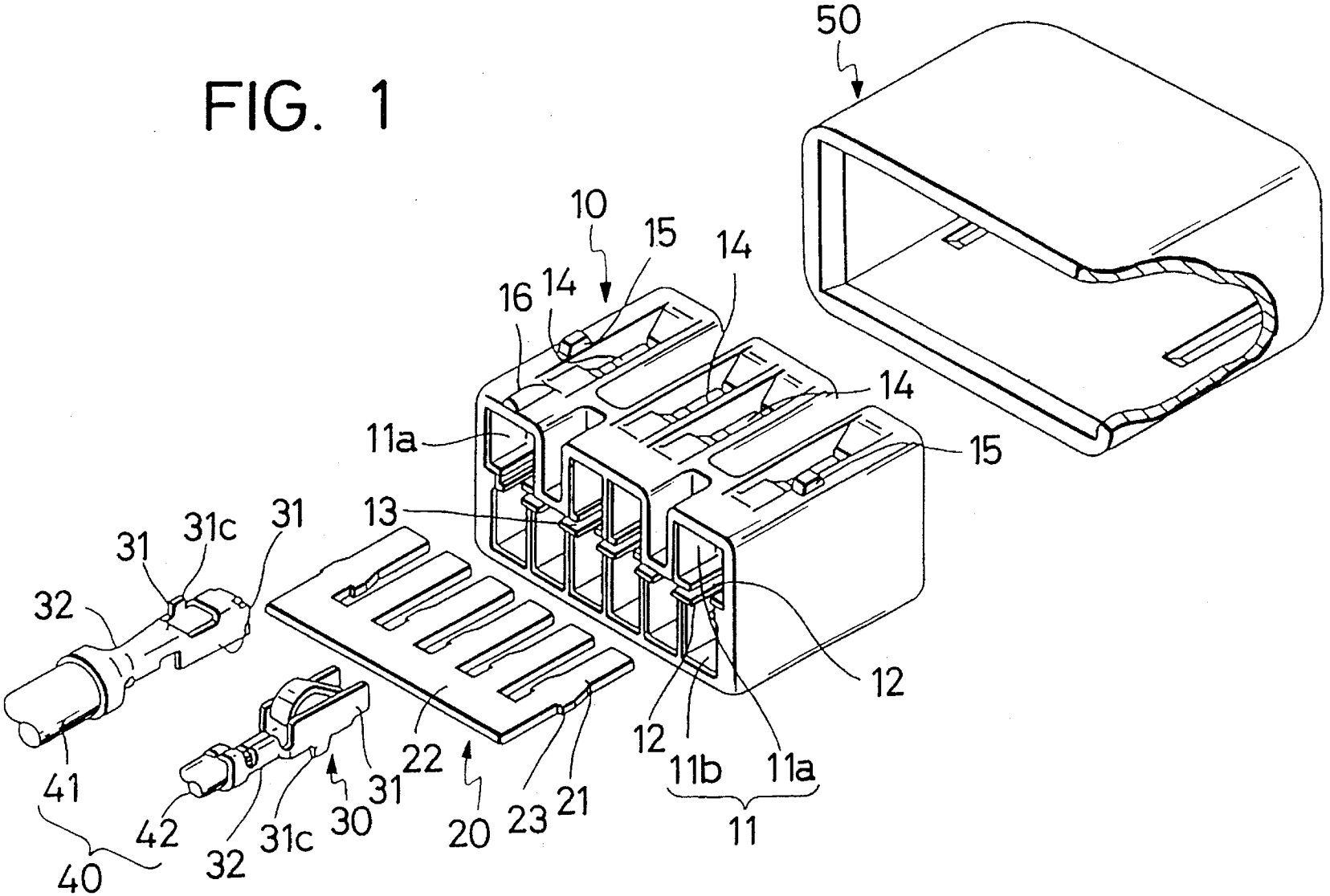
FIG. 1 is a perspective view of the joint connector of a first embodiment of the present invention.

FIG. 1 is a perspective view of the joint connector of the present invention. The connector housing 10 is formed into a box-shape having an opening on one side, and a bulkhead is provided in the connector housing 10 from the opening side to the inside, so that the inside of the connector housing 10 is divided into an upper row (first set) and a lower row (second set) of terminal receiving chambers. Four terminal accommodating chambers 11 are provided in the upper row and six terminal accommodating chambers 11 are provided in the lower row, that is, ten terminal accommodating chambers 11 are provided in total in the connector housing 10. In the terminal accommodating chambers 11, the dimensions of the terminal accommodating chambers 11*a* located on both sides of the upper row are larger than those of the terminal accommodating chambers 11*b* located between the terminal accommodating chambers 11*a*.

A space or central chamber 13 is formed between the terminal accommodating chambers 11 located in the upper row and those located in the lower row so that a plate-shaped joint terminal 20 can be inserted into the space or central chamber 13. A cutout portion (communicating hole) 12 communicating with the space or central chamber 13 is formed on a peripheral wall that faces the space of each terminal accommodating chamber 11. This cutout portion (communicating hole) 12 is provided in the longitudinal direction of the connector housing 10.

The joint terminal 20 is a conductive plate member capable of being inserted into the space 13 formed between the upper and lower terminal accommodating chambers 11. At the fore end of the joint terminal 20, tab-shaped contacting portions 21 are formed so that the joint terminal 20 can be inserted between the cutout portions 12 opposed to each other. At the rear end of the joint terminal 20, a connecting portion 22 is formed so that the contacting portions 21 can be connected with each other. The contacting portions 21, separate from each other, are formed into a strip-shape, and several protrusions 23 are provided for preventing the joint terminal 20 from being disengaged. In the central chamber or space 13, connecting walls for connecting the upper and lower portions are provided. In this case, the configuration of the connecting wall coincides with each contacting portion 21. When the joint terminal 20 is inserted into the connector housing 10, the protrusion 23 of the contacting portion 21 advances, coming into contact with the connecting wall, and by the action of the protrusion 23 of the contacting portion 21, it is difficult for the joint terminal 20 to be withdrawn after it has reached the stopping position.

Figure 2:
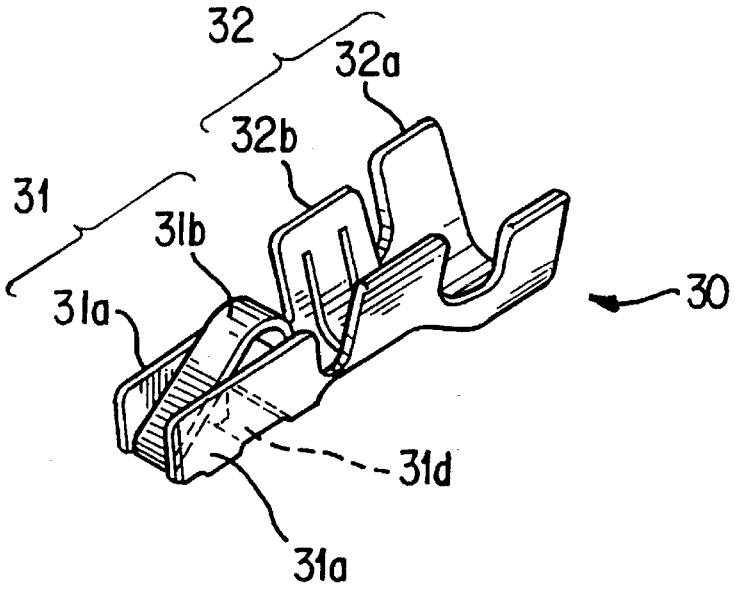
FIG. 2 is a perspective view of the terminal used for a large electric connecting wire.
Figure 3:
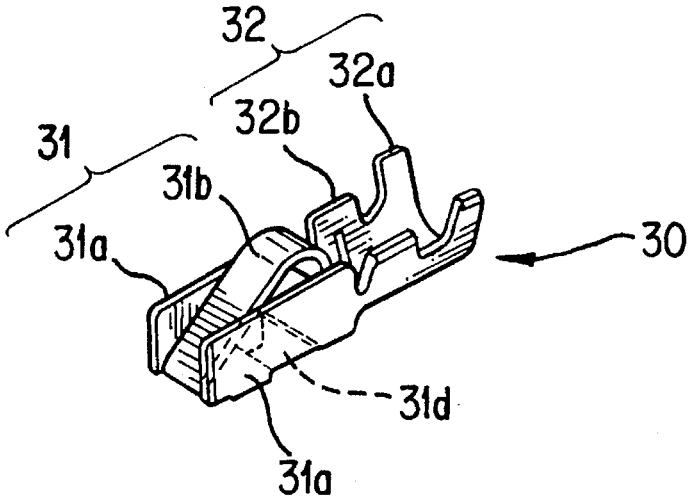
FIG. 3 is a perspective view of the terminal used for a small electric connecting wire.
Figure 4:
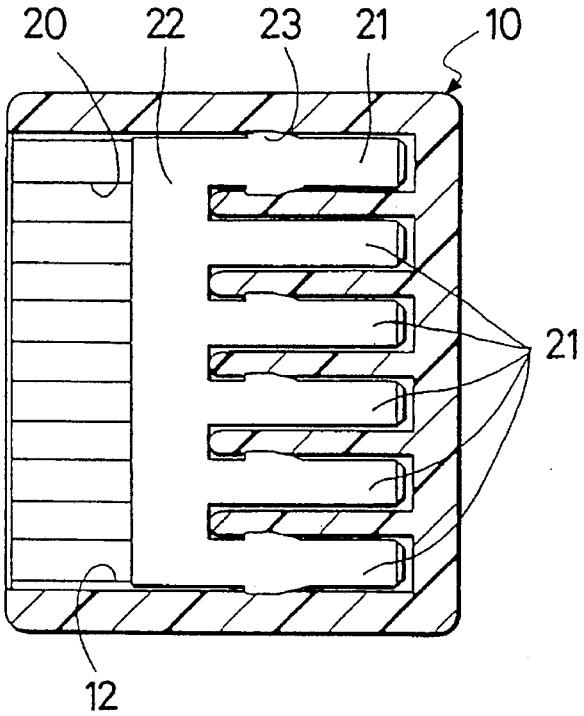
FIG. 4 is a sectional view showing a condition in which the joint terminal is inserted into the joint chamber.

As illustrated in FIGS. 2 and 3, a contacting portion 31 for contacting the contacting portion 21 of the joint terminal 20 is provided at the fore end of the terminal 30, and a barrel portion 32 for holding and connecting a connecting wire 40 is provided at the rear end of the terminal 30. FIG. 2 shows a terminal 30 applied to a large connecting wire 41 and FIG. 3 shows a terminal 30 applied to relatively small connecting wire 42. Concerning the terminals 30 applied to the connecting wires of large and small sizes, the configurations of the contacting portions 31 are the same, however, the dimensions of the barrel portions 32 are different according to the sizes of the connecting wires 40.

Both sides of the contacting portion 31 are raised so that side walls 31*a*, 31*a* are formed. A strip-shaped tongue-member 31*b*, the width of which is determined so that the tongue-member 31*b* can get into a space between the side walls 31*a*, 31*a*, is curved in such a manner that the tongue-member 31*b* is bent toward the side wall 31*a*. The tongue-member 31*b* is provided in this way to give resilience. In this connection, a portion of the bent portion of one of the side walls 31*a* protrudes downward so that the guide protrusion 31*c* is formed, and a lock hole 31*d* is formed on a wall opposite to the side on which the tongue-member 31*b* is bent in the contacting portion 31.

An inner part of the terminal accommodating chamber 11 is formed into a configuration in which the contacting portion 31 can be inserted into the terminal accommodating chamber 11. When a wall on the outer periphery side of the terminal accommodating chamber 11 of the connector housing 10 is cut out, a flexible locking piece 14 is formed. The locking piece 14 has a protrusion 14*a* capable of engaging with the aforementioned lock hole 31*d*. As a result of the foregoing, the terminal accommodating chamber 11 is communicated with the outside through the cutout portion formed in the periphery of the locking member 14.

The barrel 32 includes an insulation barrel 32*a* for holding a covered portion of the connecting wire 40 and a wire barrel 32*b* for holding a core. The dimensions of the insulation barrel 32*a* and the wire barrel 32*b* are respectively determined in accordance with the diameters of the large connecting cable 41 and the small connecting cable 42.

A cap 50 is formed into a box-shape into which the connector housing 10 can be inserted. Angle-shaped engaging protrusions 15 are provided at both end portions on the upper and lower surfaces of the connector housing 10, and engaging grooves 51 capable of engaging the protrusions 15 are provided on an inner peripheral surface of the cap 50 corresponding to the engaging protrusions 15, wherein the engaging grooves 51 are provided in a portion located from the middle to the inner part on the inner peripheral surface of the cap 50. In this example, the cap 50 covers the entire outer periphery of the connector housing 10. However, the cap 50 may cover only the outer periphery of the locking piece 14 so that the gaps can be covered.

Next, the operation of the connector of this example will be explained.

The joint terminal 20 is inserted into the connector housing 10. The ends of the contacting portions 21 of the joint terminal 20 come into contact with a peripheral wall of the terminal accommodating chamber 11. Therefore, the contacting portions 21 are opposed to all terminal accommodating chambers 11 through the cutout portions 12.

One end of the connecting wire 41 is connected onto the primary side, and the other end of the connecting wire 41 is connected to the terminal 30 for use with a large-sized wire, wherein the other end of the connecting wire 41 is held by the barrel portion 32 of the terminal 30. One end of the secondary side connecting wire is connected to a plurality of electric appliances, and the other end of each connecting wire 42 is held and crimped by the barrel portion 32 of the terminal 30 for use with a small-sized wire.

Figure 6:
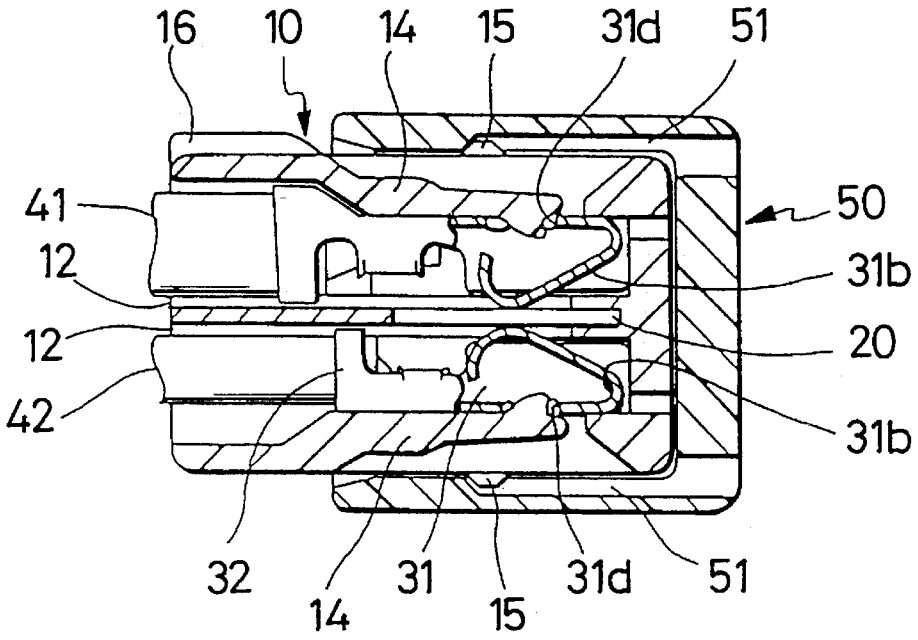
FIG. 6 is a sectional view showing a condition in which the connector housing is covered with the cap.

With respect to the connecting wire 41, the contacting portion 31 is inserted into the terminal accommodating chamber 11*a* until the locking piece 14 engages the lock hole 31*d*. With respect to the plurality of connecting wires 42, the contacting portion 31 is inserted into the terminal accommodating chamber 11*b* until the protrusion 14*a* of the locking piece 14 engages with the lock hole 31*d*. As illustrated in FIG. 6, when the contacting portion 31 is inserted into the inner portion of the terminal accommodating chamber 11, the protrusion 14*a* of the locking piece 14 of the connector housing 10 enters into and engages the lock hole 31*d* of the terminals 30, so that the contacting portion 31 is held in the terminal accommodating chamber 11. At this time, the tongue-member 31*b* of the contacting portion 31 faces the cutout portion 12 and protrudes from the cutout portion 12. Accordingly, the tongue-member 31*b* comes into contact with the contacting portion 21 of the joint terminal 20 that is opposed to and held by the cutout portion 12.

As described above, the contacting portions 21 of the joint terminal 20 are inserted into the terminal accommodating chambers 11 being opposed to all cutout portions 12. Therefore, the contacting portions 31 of the terminal 30 accommodated in the terminal accommodating chambers 11 are electrically connected with each other through the contacting portions 21 and the connecting portion 22 of the joint terminal 20. That is, the large connecting wire 41, connected with the primary side, is connected with a plurality of small connecting wires on the secondary side through the joint terminal 20.

Figure 5:
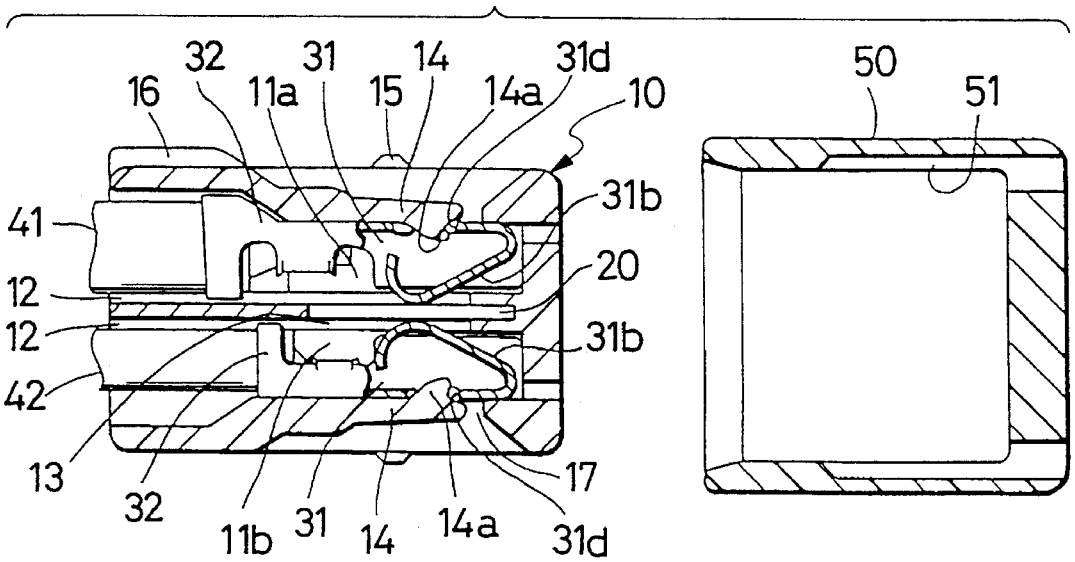
FIG. 5 is a sectional view showing a process in which the cap is attached to the connector housing.
Figure 7:
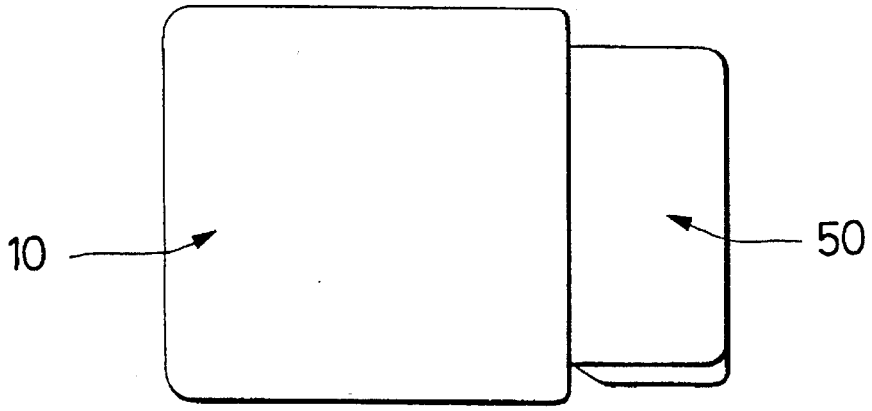
FIG. 7 is a side view showing a condition in which the connector housing is covered with the cap.
Figure 8:
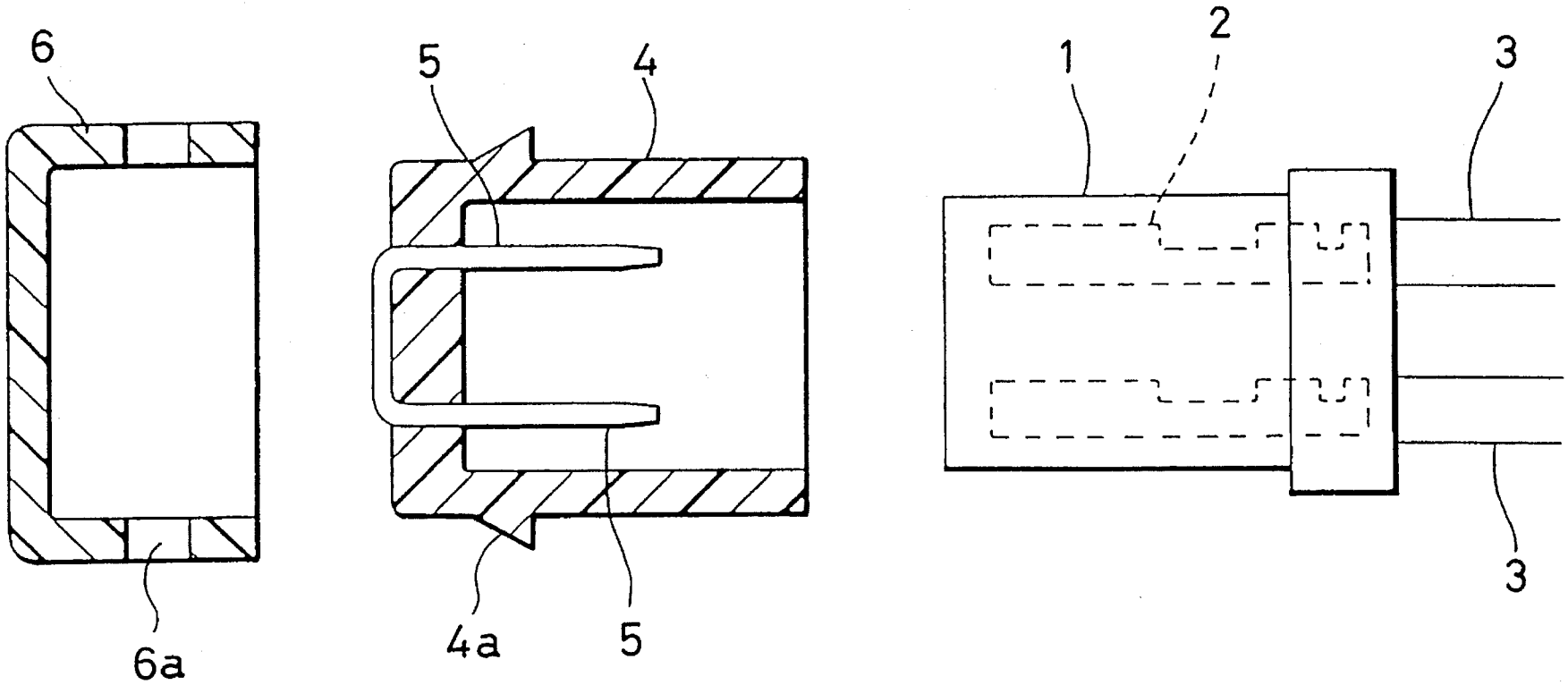
FIG. 8 PRIOR ART
FIG. 8 is a sectional view of the conventional joint connector.

In this example, the connecting wire 41 is connected with the primary side so that a current of high intensity is made to flow in the connecting wire 41. Therefore, in view of insulation, problems may be encountered when the terminal 30 connected with the connecting wire 41 is exposed to the outside through a gap 17 located in the periphery of the locking piece 14. In order to solve the above problems, the connector housing 10 is inserted into an opening of the cap 50 as illustrated in FIG. 5. At the first stage of insertion, the opening of the cap 50 is forcibly extended by the engaging protrusion 15. However, when the connector housing 10 is inserted until the protrusion 16 provided on the outer peripheral surface of the connector housing 10 comes into contact with an opening end portion of the cap 50, as illustrated in FIGS. 6 and 7, the engaging protrusion 15 is opposed to and engaged with the engaging groove 51 provided on the inner peripheral surface of the cap 50. Therefore, both are engaged with each other, and the cap 50 is not easily disconnected from the connector housing 10.

When the large-sized connecting wires 41 are not used and only small-sized wires used for a signal system are joined, an adequate insulating property can be provided only by the thickness of the connector housing 10. Therefore, it is not necessary to use the cap 50. When the cap 50 is not used, the overall dimensions of the joint connector are further reduced, so that it is possible to apply the joint connector to a small space.

In this connection, in the above example, both the contacting portion 31 of the terminal 30 for use with a large-sized wire and the contacting portion 31 of the terminal 30 for use with a small-sized wire can be held by the common inner parts of the terminal accommodating chambers 11*a*, 11*b*. Accordingly, even the small-sized connecting wire 42 can be held in the terminal accommodating chamber 11*a*.

In this example, the joint terminal 20 and the terminal 30 are accommodated in the integrated connector housing 10. Accordingly, the outside dimensions of the joint connector can be reduced. The terminal accommodating chamber 11 is provided with the cutout portion 12, and the lock arm 14 is provided on the opposite side of the cutout portion 12. Therefore, only the bulkhead may be provided on the side of the connector housing 10, and a plurality of terminal accommodating chambers 11 can be provided in parallel, so that it is possible to reduce the size. Because it is not necessary to provide a cover for covering the connector housing 10, the size of the joint connector can be further reduced.

In another embodiment of the invention, the connector housing 10 is formed cylindrical, and the lock arm 14 protrudes from the connector housing 10 independently from the peripheral wall, and there are provided no gaps for communicating the terminal accommodating chamber with the outside in the outer periphery of the connector housing 10. Accordingly, even if a cap for covering the connector housing 10 is not provided, the insulation property of the joint connector can be maintained high when a large amount of electric power is transmitted through the joint connector. Therefore, the joint connector of the present invention can be applied not only to a portion through which signals are transmitted but also to a portion through which a current of high intensity is made to flow.

The invention has been described in detail with reference to the drawings, which are intended to be illustrative, not limiting. Various modifications can be made without departing from the spirit and scope of the invention as defined in the appended claims.

What is claimed is:

1. A joint connector comprising:

a plate-shaped short circuit terminal;

a terminal strip having a flexible connecting piece connected at an end of a connecting wire, said flexible connecting piece protruding in a direction perpendicular to a longitudinal axis of the wire, said terminal strip also having an engaging recess portion provided on a side opposite to the flexible connecting piece;

a housing having a central chamber extending into a first peripheral wall for accommodating and holding said plate-shaped short circuit terminal, said housing having a plurality of parallel terminal accommodating chambers extending into the first peripheral wall and adjacent the central chamber, wherein a communicating hole is provided to communicate each of the terminal accommodating chambers with the central chamber, and wherein said flexible connecting piece is protrudable into said central chamber through said communicating holes when said terminal strip is inserted into one of said plurality of terminal accommodating chambers, each of said terminal accommodating chambers also having a flexible lock arm engageable with said engaging recess portion, each of said flexible lock arms being provided on a side opposite to a side where said central chamber is formed, wherein a second peripheral wall having a cutout portion for each of said lock arms is provided so that an inside of the housing can be communicated with an outside of the housing; and a detachable cap for covering an outer periphery of said housing so as to cover each of the cutout portions formed on the outer periphery of said housing.

2. A joint connector comprising:

a plate-shaped short circuit terminal;

a terminal strip having a flexible connecting piece connected at an end of a connecting wire, said flexible connecting piece protruding in a direction perpendicular to a longitudinal axis of the wire, said terminal strip also having an engaging recess portion provided on a side opposite to the protruding flexible connecting piece; and a cylindrical housing having a central chamber extending into a first peripheral wall for accommodating and holding said plate-shaped short circuit terminal, said housing also having a plurality of terminal accommodating chambers extending into the first peripheral wall and adjacent the central chamber, wherein a communicating hole is provided in each of the terminal accommodating chambers adjacent the central chamber, and wherein said flexible connecting piece is protrudable into said central chamber through one of said communicating holes when said terminal strip is inserted and accommodated within one of the terminal accommodating chambers, each of said terminal accommodating chambers having a flexible lock arm engageable with said engaging recess portion, each of said flexible lock arms being provided on a side opposite to said central chamber, wherein each of said flexible lock arms protrudes from a second peripheral wall into the terminal accommodating chamber independently from the second peripheral wall.

3. A connector comprising:

a housing having a first set of terminal receiving chambers extending into a first peripheral wall, a second set of terminal receiving chambers extending into the first peripheral wall, and a central chamber extending into the first peripheral wall that provides communication between the first and second sets of terminal receiving chambers, and a joint terminal insertable within the central chamber to electrically connect terminals located within the first and second sets of terminal receiving chambers.

4. The connector of claim 3, wherein each of the first and second sets of terminal receiving chambers includes a cutout portion that communicates with the central chamber.

5. The connector of claim 3, wherein the housing is a cylindrical housing.

6. The connector of claim 3, wherein each of the first and second sets of terminal receiving chambers includes a locking pawl for engaging a locking hole of a metal terminal.

7. The connector of claim 6, wherein each locking pawl comprises a flexible tab formed independently of a peripheral wall of the housing.

8. The connector of claim 6, wherein each pawl comprises a flexible tab formed as a part of a peripheral wall of the housing.

9. The connector of claim 8, further comprising a cover for covering an outer surface of said peripheral wall.

10. The connector of claim 3, wherein said joint terminal comprises a connecting portion and a plurality of contacting portions for electrically communicating terminals disposed in said first and second sets of terminal receiving chambers, and each of said plurality of contacting portions being connected to the connecting portion.

11. The connector of claim 10, wherein each of the plurality of contacting portions includes at least one protrusion for engaging a side wall of the central chamber.

12. A method for connecting a plurality of terminals located in terminal receiving chambers of a housing, the method comprising:

inserting said terminals within said terminal receiving chambers extending into a first peripheral wall of said housing;

providing communication between the terminal receiving chambers via a central chamber extending into the first peripheral wall of said housing, said central chamber having an electrically conductive joint terminal disposed therein; and establishing an electrical connection between each of the terminals and the joint terminal, thereby connecting each of the terminals to each other.

13. The method of claim 12, wherein the communication provision includes providing each of the terminal receiving chambers with a cutout portion adjacent said central chamber, said terminals each having a tongue-like portion that protrudes through the cutout portion.

14. The method of claim 12, further comprising providing each of said terminal receiving chambers with a locking pawl for mechanically engaging one of said terminals.

15. The method of claim 12, further comprising covering the housing with a cover.

* * * * *